US006817819B2

(12) United States Patent
Olson et al.

(10) Patent No.: US 6,817,819 B2
(45) Date of Patent: Nov. 16, 2004

(54) EASY-OPEN CONTAINER END

(75) Inventors: Christopher J. Olson, Superior, CO (US); Harold Cook, Jr., Evergreen, CO (US)

(73) Assignee: Omnitech International, Inc., Golden, CO (US)

( * ) Notice: Subject to any disclaimer, the term of this patent is extended or adjusted under 35 U.S.C. 154(b) by 9 days.

(21) Appl. No.: 10/306,921

(22) Filed: Nov. 27, 2002

(65) Prior Publication Data

US 2003/0116570 A1 Jun. 26, 2003

Related U.S. Application Data

(60) Provisional application No. 60/333,953, filed on Nov. 27, 2001.

(51) Int. Cl.[7] ..... B21D 51/44

(52) U.S. Cl. ..... 413/12; 413/14; 413/16; 413/17; 220/266; 220/270; 220/309.1

(58) Field of Search ..... 413/12, 13, 14, 413/15, 16, 17, 25; 220/260, 266, 267, 270, 276, 277, 279, 309.1, 309.2, 310.1

(56) References Cited

U.S. PATENT DOCUMENTS

| | | | | |
|---|---|---|---|---|
| 677,051 A | | 6/1901 | Ams | |
| 811,894 A | | 2/1906 | Alden, Jr. | |
| 1,175,942 A | | 3/1916 | Finney | |
| 1,733,684 A | | 10/1929 | Ericsson | |
| 1,838,302 A | * | 12/1931 | Evans | 220/267 |
| 1,878,677 A | | 9/1932 | Curtis | |
| 2,007,584 A | | 7/1935 | Peckham | 220/49 |
| 2,149,308 A | | 3/1939 | Peckham | 220/49 |
| 2,350,870 A | | 6/1944 | Bogner | 220/49 |
| 2,681,025 A | | 6/1954 | Bogner | 113/15 |
| 3,268,105 A | | 8/1966 | Geiger | 220/49 |
| 3,604,615 A | | 9/1971 | Barreman | 229/51 |
| 3,625,392 A | * | 12/1971 | Kaminski | 220/270 |
| 3,687,099 A | * | 8/1972 | Franek et al. | 413/14 |
| 3,799,389 A | | 3/1974 | Bloeck | 220/49 |
| 5,950,859 A | | 9/1999 | Nguyen et al. | 220/276 |

FOREIGN PATENT DOCUMENTS

| | | |
|---|---|---|
| GB | 436722 A | 10/1935 |
| GB | 505454 A | 5/1939 |
| GB | 646596 A | 11/1950 |

OTHER PUBLICATIONS

PCT/US 02/38237; PCT International Search Report; Mar. 13, 2003.

* cited by examiner

*Primary Examiner*—Ed Tolan
(74) *Attorney, Agent, or Firm*—Cochran Freund & Young LLC

(57) ABSTRACT

The disclosed invention describes a container end that can be easily opened and does not rely on a conventional metal tab, riveted onto the end, thereby avoiding the problems and the cost associated with such a tab. The invention utilizes a traditional container end shell with a separate and distinct piece that is formed independently and is inserted into a countersink which is placed on the outer surface of the container end shell. The removal of this separate piece exerts a force or causes a change in the properties of the container wall in the countersink area, initiating and proliferating a discontinuity in the container wall, thereby creating an opening in the container. This change in the properties of the container wall can be mechanical, chemical, thermal or any other modality, which has the ability to influence the integrity of the container wall.

36 Claims, 11 Drawing Sheets

EASY-OPEN CONTAINER END

CROSS REFERENCE TO RELATED APPLICATIONS

This application is based upon and claims the benefit of U.S. provisional application No. 60/333,953, entitled "EASY-OPEN CONTAINER END," filed Nov. 27, 2001, the entire disclosure of which is herein specifically incorporated by reference for all that it discloses and teaches.

BACKGROUND OF THE INVENTION a. Field of the Invention

The present invention relates to a device and method of production for facilitating an easy-open end for a container.

b. Description of the Background

Full aperture easy-open can ends for food and non-food products have been present in the marketplace for more than 30 years. Nearly all feature a tab, which is formed independently and is riveted on to the container end shell. The material in the shell is scored near the outer diameter of the end so that when the tab is lifted, the tab perforates the score and then the score fractures as the tab is pulled back. Numerous advancements have been made on score design, tab design, protective folds to reduce the risk of cuts to the user, etc. Even so, the basic premise of the design, function and manufacture of conventional easy-open can ends, has remained nearly unchanged for the past quarter century.

Conventional easy-open can ends experience a variety of problems. In many instances, the forces necessary to fracture and propagate or tear the score can be excessive, especially for older consumers. Because this score is a point of structural debility, present designs are forced to attempt to minimize this weakness in order to stand up to processing and distribution. This conflict has resulted in preventing significant progress in reducing fracture and tear forces. These scores are also subject to corrosion in many applications when exposed to the product or environment. In addition to the problems created by the scoring of the can ends, numerous geometrical problems can arise when these containers are utilized in hyper or hypobarometric applications. For example, when cans are vacuum-sealed, the center panel of the container end is pulled inward which thereby forces the tab downwardly. This can make access to the tab difficult in many cases. Similarly, in pressure pack applications where a domed shaped end is required, conventional scoring and tab openings are not suitable.

Many conventional easy-open can ends also require the use of a riveting mechanism to retain the tab in place. These rivets can add considerable time and expense to the manufacturing process and can be sources of corrosion, fractures and leaks. Because basic easy-open end designs are not optimized for strength relative to buckle resistance, they require the use of heavy gauge materials that add to product weight and cost. On most designs used for processed food products, a countersink is required to meet minimal strength requirements. This countersink pushes the score and opening diameter towards the center of the can, often impeding the removal of the food product, especially with products that are semi-solid (like pet food).

SUMMARY OF THE INVENTION

The present invention overcomes the disadvantages and limitations of the prior art by providing a container end that can be easily opened and does not rely on a conventional metal tab, riveted onto the end, thereby avoiding the problems and the cost associated with such a tab. The present invention can utilize a traditional can end shell, with a unique design that allows traditional double seaming of the end onto the can body. One embodiment of the present invention utilizes a traditional container end shell with a separate and distinct ring piece that is formed independently and is inserted into a closed loop countersink which is placed on the outer surface of the container end shell. The removal of this ring exerts a force in the countersink area, initiating and proliferating a discontinuity in the container end, thereby creating an opening in the container. Another embodiment functions the same as the first embodiment except the score in the countersink area is first pierced before the discontinuity is proliferated.

The present invention may therefore comprise a method of creating an opening in a closed shell container comprising: creating a closed loop countersink that protrudes inward from the outer surface of the container shell, creating an area of weakness throughout the closed loop on a portion of the countersink to facilitate preferential separation along the area of weakness, placing a semi-toroidal shaped ring within the countersink, the countersink having a depth greater than the radius of the ring, crimping the countersink on at least one lateral surface to a dimension less than the diameter of the ring, between the portion of the countersink that retains the ring and the outer surface of the container shell, to retain the ring within the countersink, removing the ring from within the crimped countersink to effect a change in the material properties throughout the area of weakness on the countersink thereby propagating a discontinuity in the container material and creating the opening in the closed shell container.

The present invention may also comprise a device for creating an opening in a closed shell container comprising: a closed loop countersink that protrudes inward from an outer surface of the container shell, an area of weakness throughout the closed loop on a portion of the countersink that facilitates a preferential separation along the area of weakness, a semi-toroidal shaped ring placed within the countersink, the countersink having a depth greater than the radius of the ring, a crimp to retain the ring within the countersink on at least one lateral surface of the countersink to a dimension less than the diameter of the ring, the crimp located between the portion of the countersink that retains the ring, and the outer surface of the container shell, a rivetless actuator to remove the ring from within the crimped countersink, the removal effecting a change in the material properties throughout the area of weakness on the countersink and create the opening in the closed shell container.

Numerous benefits may be afforded by the disclosed embodiments and include the elimination of conventional rivets or tabs and the problems associated with these parts. By forming the metal around the ring in the countersink area, there will be considerable enhancement of strength with respect to internal pressure and vacuum holding ability, leading to potential reduction or light weighting of metal used. With this invention, fracturing of the score will occur at one or two points at a time. This reduces tear forces on the end as opposed to the process used by conventional ends. This design is also less susceptible to score fractures that can occur during processing or distribution due to pressure on the tab. Also, the ring material can be specified to also act as a seal or protective material over the scored area, thereby preventing corrosion or unintentional opening.

The disclosed embodiments are highly versatile and can be used for instance with pressure packs where a dome can be incorporated inside the countersink area, adding considerably to strength since the dome area can have a of smaller diameter than a full dome on the same diameter end. Thus, the embodiments are more compatible with aftermarket devices to further enhance the ease of opening. The ability to use the removed container end to re-close the container offers a great advantage over conventional containers. This feature is further enhanced with the O-ring type seal produced by embodiments in which the ring is retained on the outer circumference of the removed end. Manufacturing cost benefits are realized since there is a reduction in the material gauge and the elimination of the rivet and tab. These costs are likely to be less than conventional easy-open can ends and could potentially rival the cost of non-easy open ends due to the enhance strength of the design.

Further advantages to the ease of use may be realized with the present invention. Since the inner panel of the can end will be removed without direct contact with fingers, the end should be less prone to cause cuts and abrasions. Furthermore, with the score in the countersink area, the residual material is less and potentially can be protected by the ring, also enhancing safety. By utilizing a large diameter inner panel, a larger aperture opening is possible leading to easier removal of product.

DETAILED DESCRIPTION OF THE INVENTION

Figure 1:
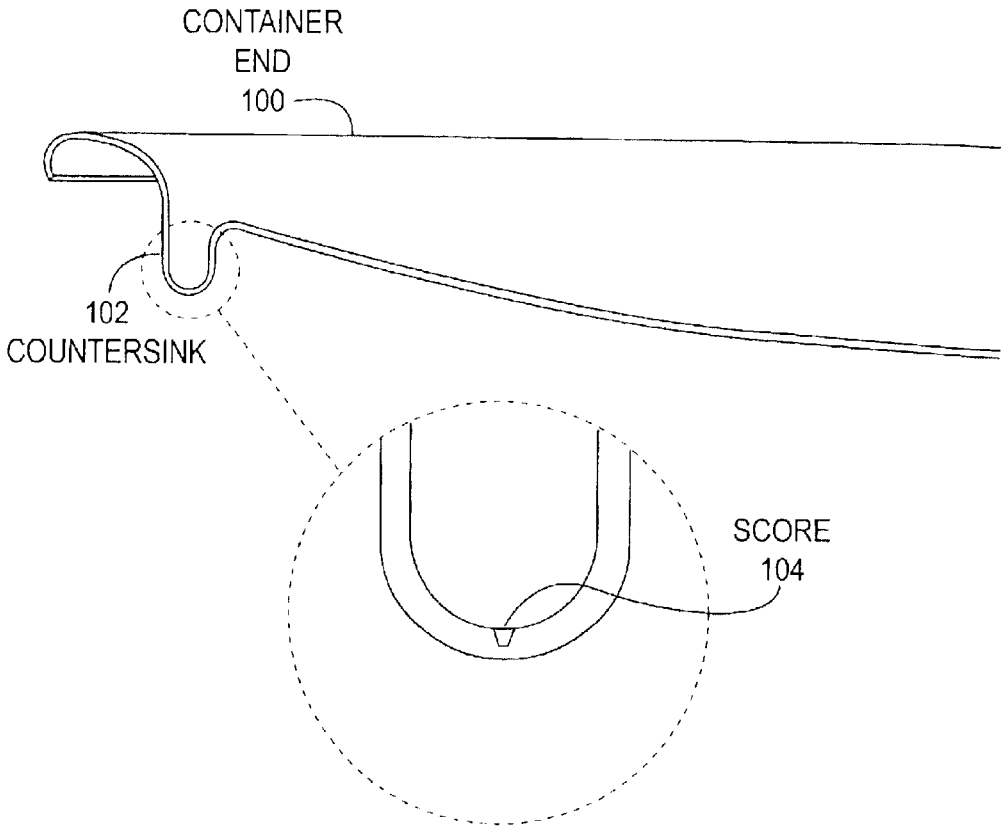
FIG. 1 is a drawing showing a container end with a circular countersink that has been scored to facilitate a sheer or fracture site.

While this invention is susceptible to embodiment in many different forms, there is shown in the drawings and will be described herein in detail specific embodiments thereof with the understanding that the present disclosure is to be considered as an exemplification of the principles of the invention and is not to be limited to the specific embodiments described.

In one embodiment, an opening is facilitated by utilizing a countersink that is typically placed as close as possible to the outer rim of the container to minimize the undercut area that might interfere with dispensing of the container contents. The end is scored in the countersink area in a conventional method utilizing any of a variety of techniques. A separate and distinct ring or tear-ring is inserted into the countersink area on the outside of the container end with one end of the ring being attached to the container mechanically and/or adhesively. The opposing end of the ring may contain a feature for gripping such as a pull tab or other type of rivetless actuator. Once the ring is inserted into the countersink, the countersink is reformed, or crimped, around the diameter of the material that makes up the ring. The score may be created on the countersink either before or after the ring is inserted and crimped in place within the countersink. The countersink is now in a position of interference with the removal of this ring. When upward pressure is exerted on the ring, it forces the countersink to expand in such a way that it causes a shear or fracture to initiate at the score. This fracture may be assisted by material fatigue experienced by crimping and expanding the countersink area. As the inserted ring is removed throughout the entire circumferential countersink, a tear occurs at the scored portion of the container end, thus, producing an opening. This removal can occur in a unidirectional manner, tearing all the way around the perimeter of the removed portion of the container end with a continuous strand of material. This removal can also occur bi-directionally, where the tear is propagated in both directions with a closed loop of material around the initial fracture point until the discontinuities reunite and establish separation between container and end.

FIG. 1 is a cross section of an implementation of the present invention showing a container end 100 with a circular, closed loop countersink 102 that has been scored 104 in a conventional manner to facilitate a sheer or fracture site. In such an application, a typical can end cap is manufactured with a conventional or slightly modified countersink 102, scored 104 in such a manner to facilitate a sheer or fracture that circumferentially excises the inner portion of the end cap to produce an opening. This score 104 can be placed on either side or both sides of the material that makes up the countersink 102.

Figure 2:
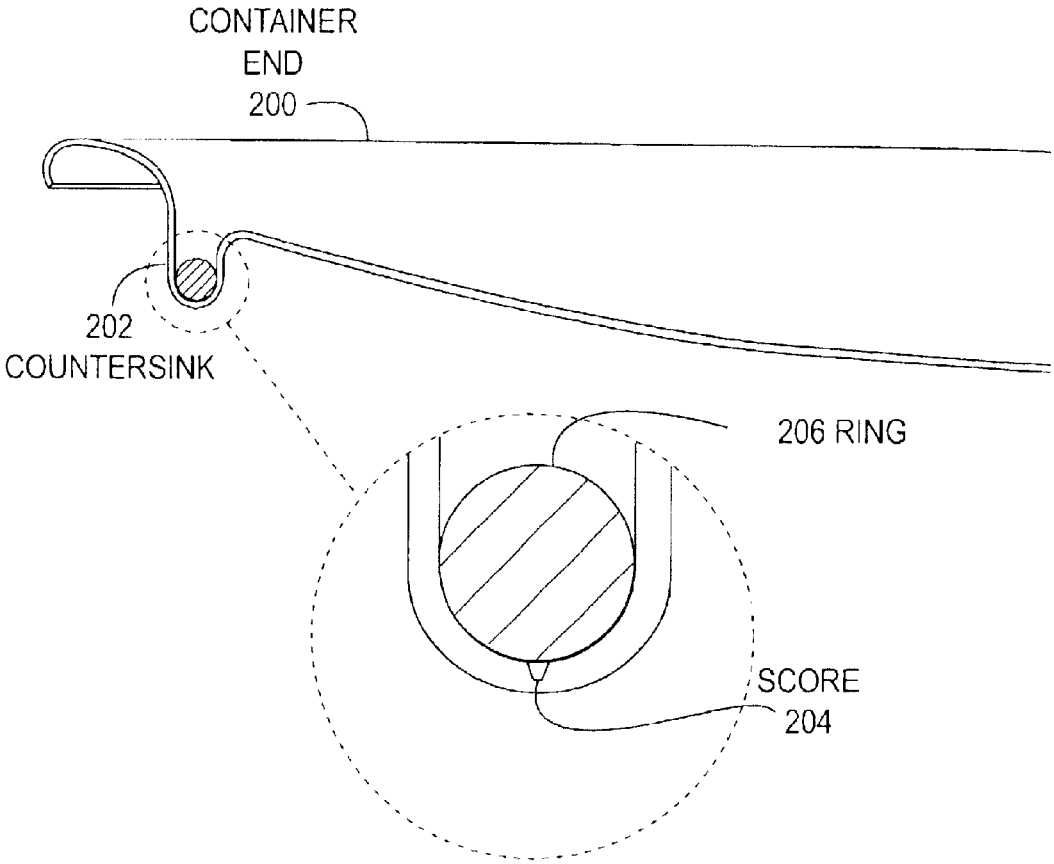
FIG. 2 is a drawing showing a container end of FIG. 1 with a ring attached on one end to the shell and inserted into the countersink.

FIG. 2 is a cross section of an implementation of the present invention showing a container end 200 with a countersink 202 which has been scored 204 in a conventional manner to facilitate a sheer or fracture site with a ring 206 attached on one end to the container end 200 and inserted into the countersink 202.

Figure 3A:
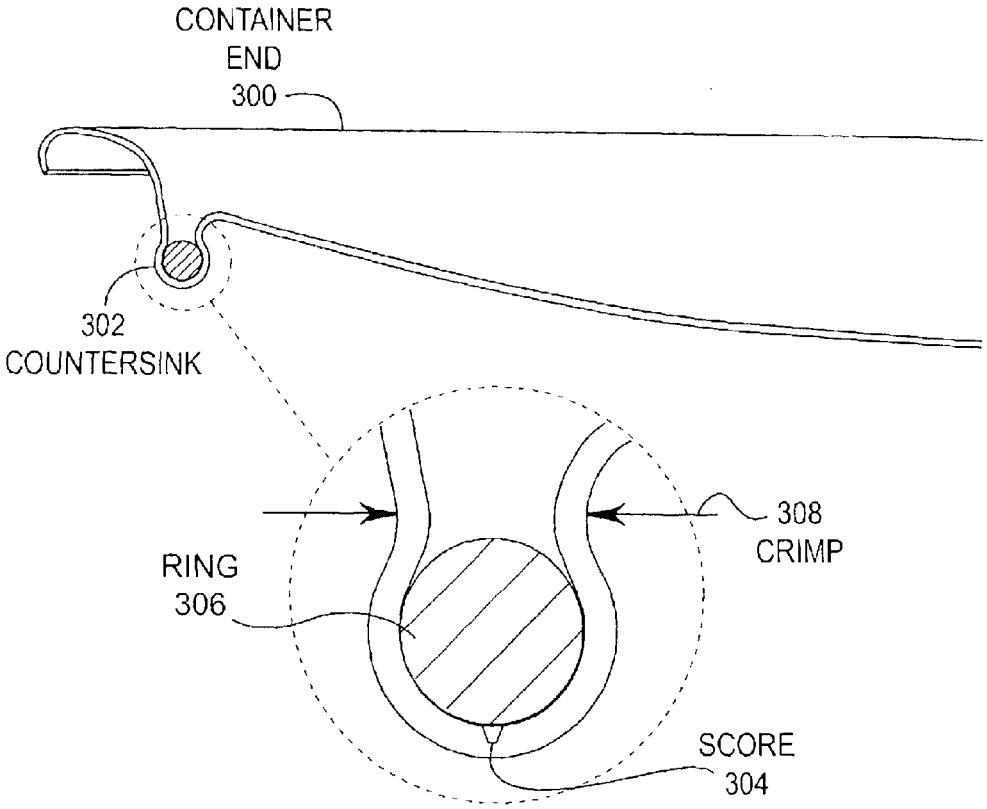
FIG. 3A is a drawing showing a container end of FIG. 2 that has been crimped to facilitate retention of the ring and to produce an interference by which fracture forces are produced by the removal of the ring.

FIG. 3A is a cross section of an implementation of the present invention showing a container end 300 with a countersink 302 which has been scored 304 in a conventional manner to facilitate a sheer or fracture site with a ring 306 attached on one end to the container end 300. The ring 306 is inserted into the countersink 302 that has been crimped 308 in both lateral sides to facilitate retention of the ring 306 and to produce an interference by which fracture forces are produced by the removal of the ring 306. These fracture forces are transmitted to the score 304 to produce a sheer.

Figure 3B:
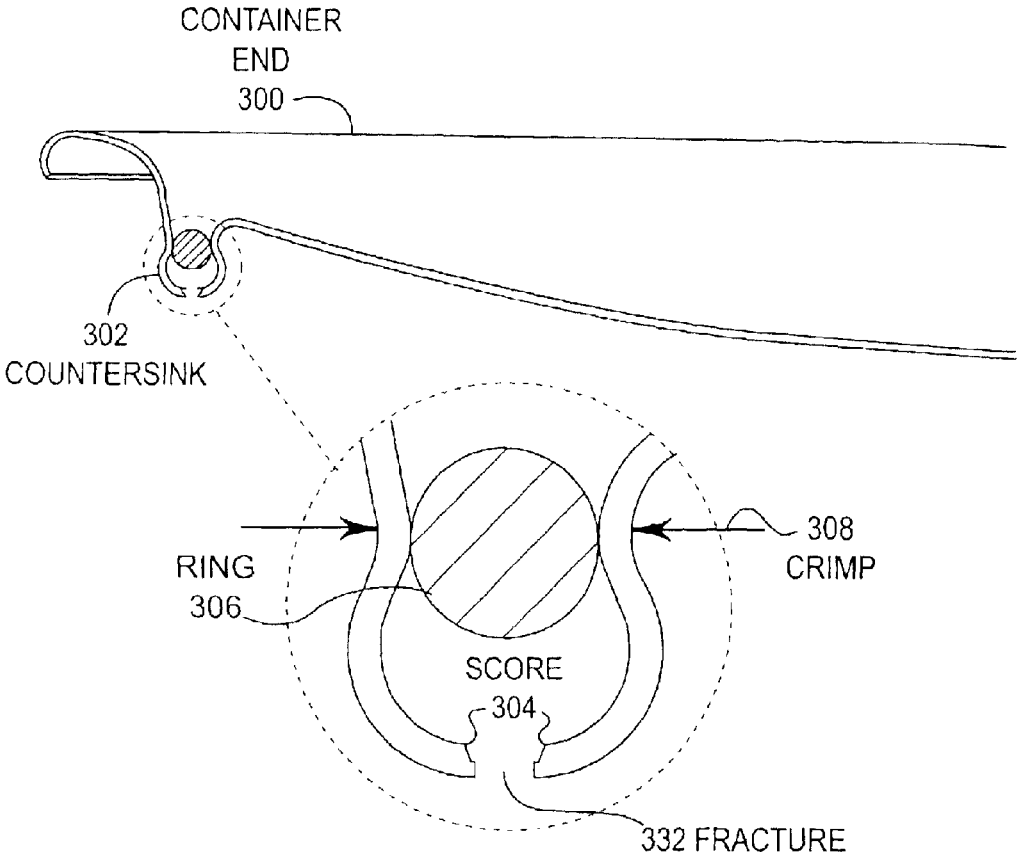
FIG. 3B is a drawing showing a container end of FIG. 3A that has been fractured by the forces produced by the removal of the ring.

FIG. 3B is a cross section of an implementation of the present invention showing a container end 300 with a countersink 302 that has been fractured 332 by the removal of a ring 306. The ring 306 is extracted from the countersink 302 that has been crimped 308 in both lateral sides, the interference caused by this removal causes force to be transmitted to the score 304 to produce fracture 332.

Figure 4:
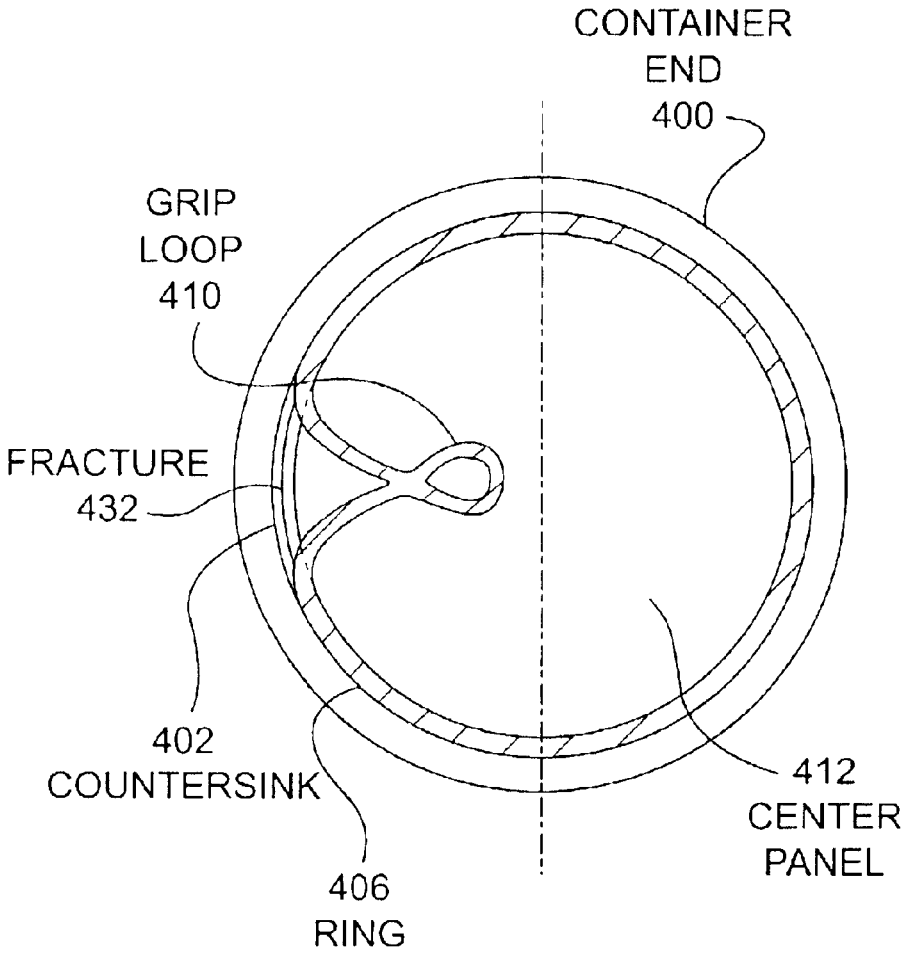
FIG. 4 is a top view drawing of a typical embodiment such as in FIG. 3A showing the ring after being inserted and attached. The countersink area reformed with the metal above the radius of the top of the ring and partially closed on one or both sides of the countersink.

FIG. 4 is a top view of a typical implementation such as in FIG. 3A showing the ring attached to a grip loop 410 after being inserted and attached and the countersink 402 area reformed with the metal above the radius of the top of the ring 406 and partially closed on one or both sides of the countersink 402. After the end is seamed onto the can, an opening will be affected by pulling upward on the extended portion of the ring 406, which will exert force on the score 404 by pulling the ring 406 through the reduced opening of the countersink 402 above the ring 406. Upon pulling the length of the ring 406 out through this opening, the full score 404 will be fractured 432 and the center panel 412 will be removed by continuing to lift on the ring 406. Whereas this ring 406 can pull in either one or both directions to facilitate the tear on the score 404, FIG. 4 demonstrates a ring 406 that is a continuous closed loop of rigid material. The ring 406 produces a fracture 432 in the score 404 in a bi-directional manner to create the opening.

Figure 5:
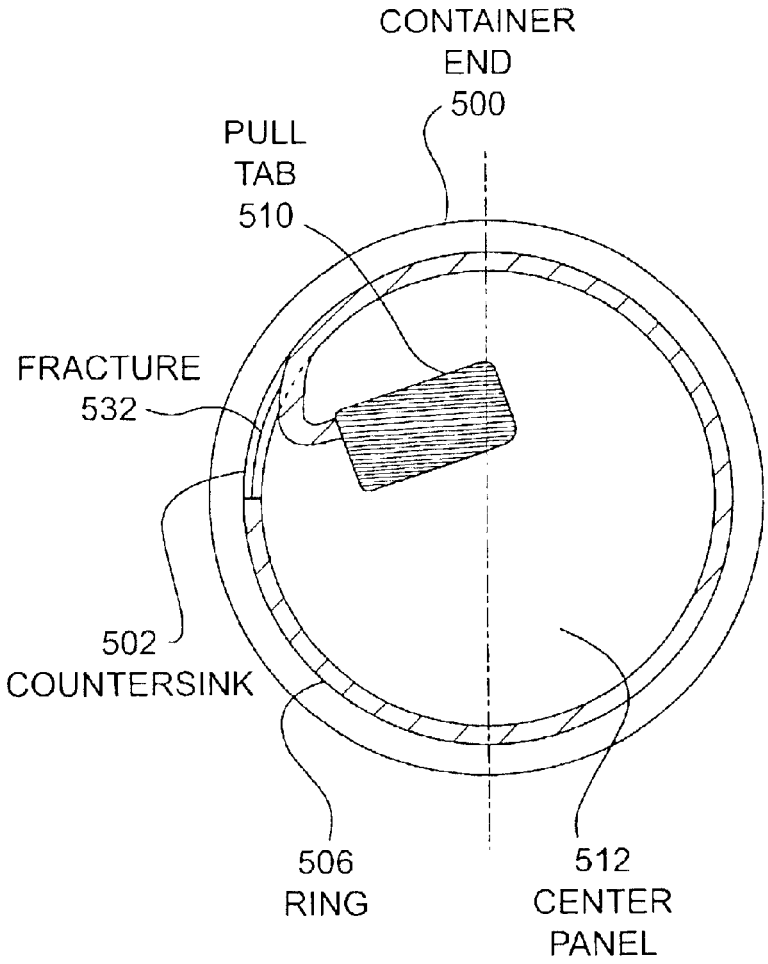
FIG. 5 is a top view drawing of a typical embodiment such as in FIG. 3A additionally showing the ring with a grip tab to initiate a fracture in the score.

FIG. 5 is a top view of a typical implementation such as in FIG. 3A additionally showing the ring with a pull tab 510 to initiate a fracture in the score 504. Also shown is the ring 506, which is inserted into (and possibly attached to) the countersink 502 and reformed with the metal above the radius of the top of the ring 506 which is partially closed on one or both lateral sides of the countersink 502, i.e., crimped 508. After the container end is seamed onto the can, an opening will be affected by pulling upward on the pull tab 510, initiating a fracture or discontinuity in the score 504. The pull tab 510 is also attached to the ring 506, which will exert force on the score 504 and propagate a tear by pulling the ring 506 through the reduced opening of the countersink 502 above the ring 506. Upon pulling the length of the ring 506 out through this opening, the entire score 504 fracture 532 will be propagated from a transfer of force created by deforming the crimp 508 with the ring 506 and the center panel 512 will be removed by continuing to lift on the ring 506. Whereas this ring 506 can pull in either one or both directions to facilitate the tear on the score 504, FIG. 5 demonstrates a ring 506 that is a continuous strand of rigid material. The ring 506 produces a fracture 532 in the score 504 in a uni-directional manner to create the opening.

An additional implementation can include a ring that is attached at a point to the portion of the container wall, which is intended to be removed. Thus, when the ring is fully excised from the countersink, and the container wall becomes nearly or fully discontinuous, additional pull on the ring is used to remove the surplus material. The aforementioned implementations may allow for an inner dome necessary for pressure packed food products, as well as the absence of such a dome as would be used with vacuum packed food products.

An additional implementation can include a countersink that is not a complete closed loop. In this instance, the center panel of the container end remains attached to a small portion of the container and hinges on that remaining material to facilitate an opening.

Figure 6:
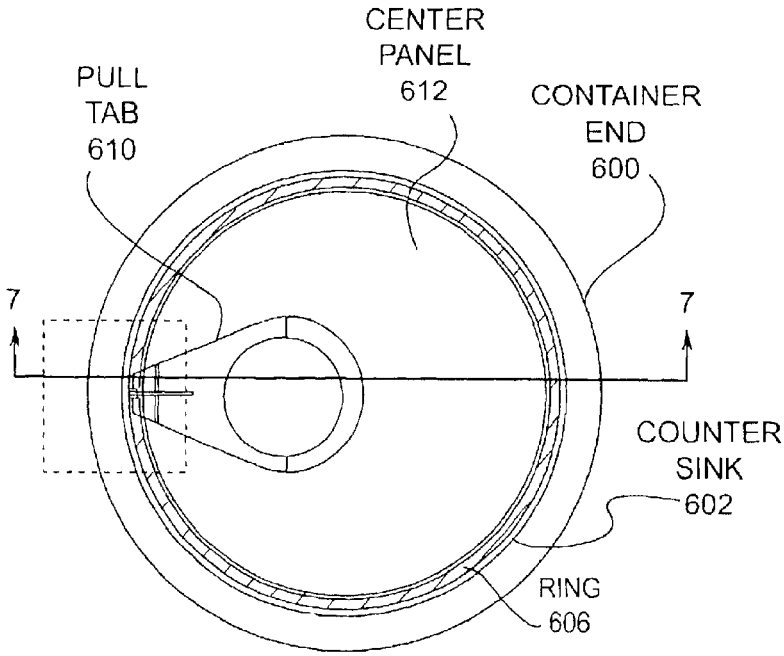
FIG. 6 is a top view drawing of a typical embodiment of a rivetless actuator that is integrally part of the ring material that is crimped in the scored countersink of the container end.

FIG. 6 is a top view drawing of a typical embodiment which includes a rivetless actuator, pull tab 610 or lever that is integrally part of, or attached to, the ring 606 material that is crimped in the circular, closed loop countersink 602 of the container end 600. In this implementation, the original fracture is initiated by lifting the pull tab 610, which connects to the ring 606, at a point that is slightly proximal to its distal end. This maximizes the lever arm of the pull tab 610 by using the ring 606 as a fulcrum to transfer force from the short lever arm of the pull tab 610 to the opposing end of the ring 606 material which is in contact with the scored section (not shown) of the counter sink 602, and initiates a discontinuity in the score. Once a discontinuity in the score is realized, the tear can be easily propagated and in one or both directions by further pulling of the pull tab 610 in a direction perpendicular to the center panel 612. One implementation allows the ring 606 to remain attached to the center panel 612 of the container after it has been removed. This facilitates the ability to reclose the container by replacing the center panel 612 in its original position in the container end 600, allowing the ring 606 to function as an O-ring type seal around the circumference of the newly formed container opening.

Figure 7:
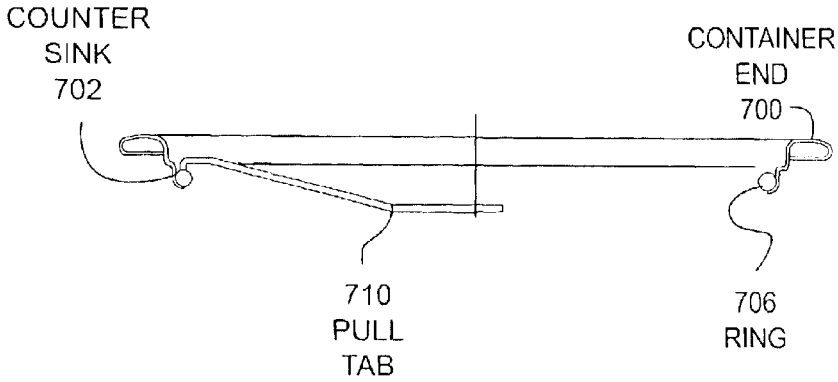
FIG. 7 is a side view drawing of section 7—7 of FIG. 6 showing a typical embodiment of a pull tab that is integrally part of the ring material that is crimped in the scored countersink of the container end.

FIG. 7 is a side view drawing of section 7—7 of FIG. 6 showing a typical embodiment of a pull tab 710 that is integrally part of the ring 706 material that is crimped in the scored countersink of the container end 700. FIG. 7 shows how the pull tab 710 can be placed in a recessed manner on the container end 700 and how the ring 706 is set into the countersink 702 that is formed into the container end 700. With this configuration, there is no need to locate the pull tab 710 in any specific radial orientation within the countersink 702, thus, simplifying manufacture.

Figure 8:
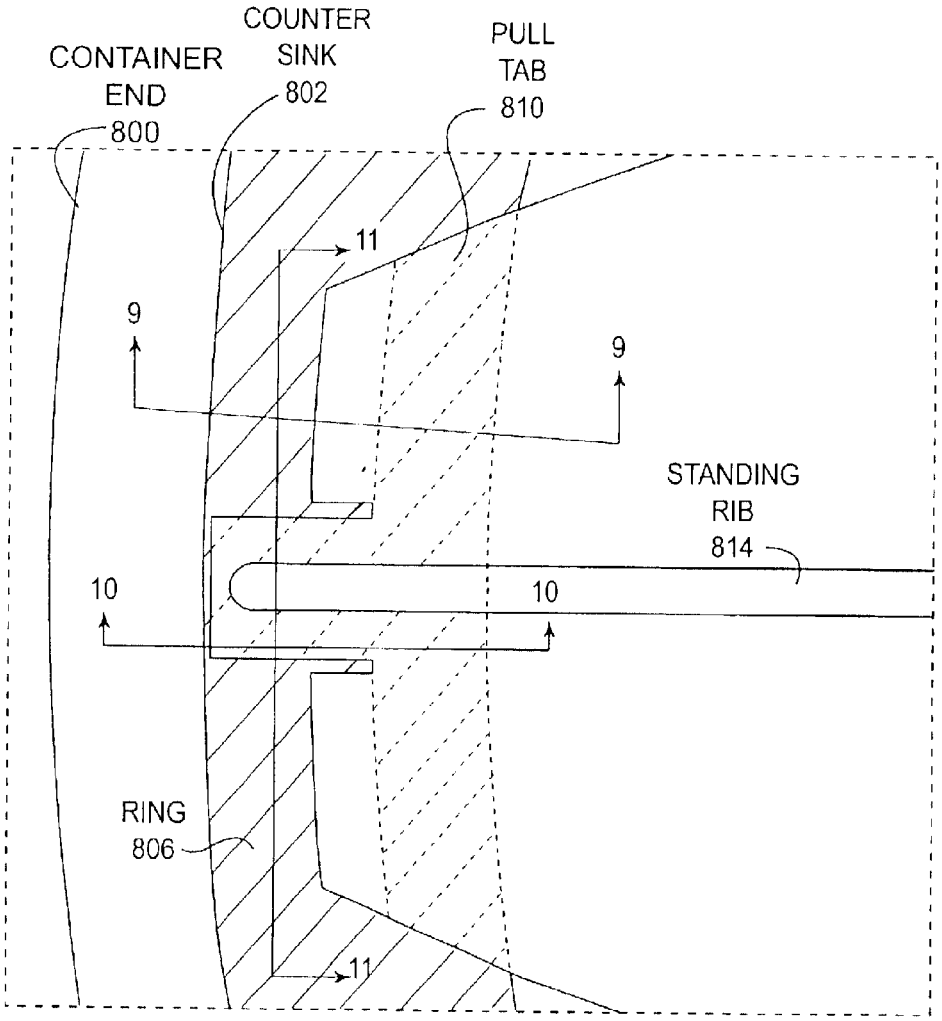
FIG. 8 is an expanded top view drawing of a typical embodiment such as in FIG. 6 and FIG. 7.

FIG. 8 is an expanded top view drawing of a typical embodiment such as in FIG. 6 and FIG. 7. As shown in FIG. 8, the pull tab 810 contains a standing rib 814 on its top surface to maintain stability and prevent buckling when the pull tab 810 is lifted. The ring 806 attached to the pull tab 810 is fit snugly into the scored countersink 802 where the ring 806 is crimped and held in place on one or both sides. This countersink 802 extends in a circular fashion around the entire outer edge of the container end 800.

Figure 9:
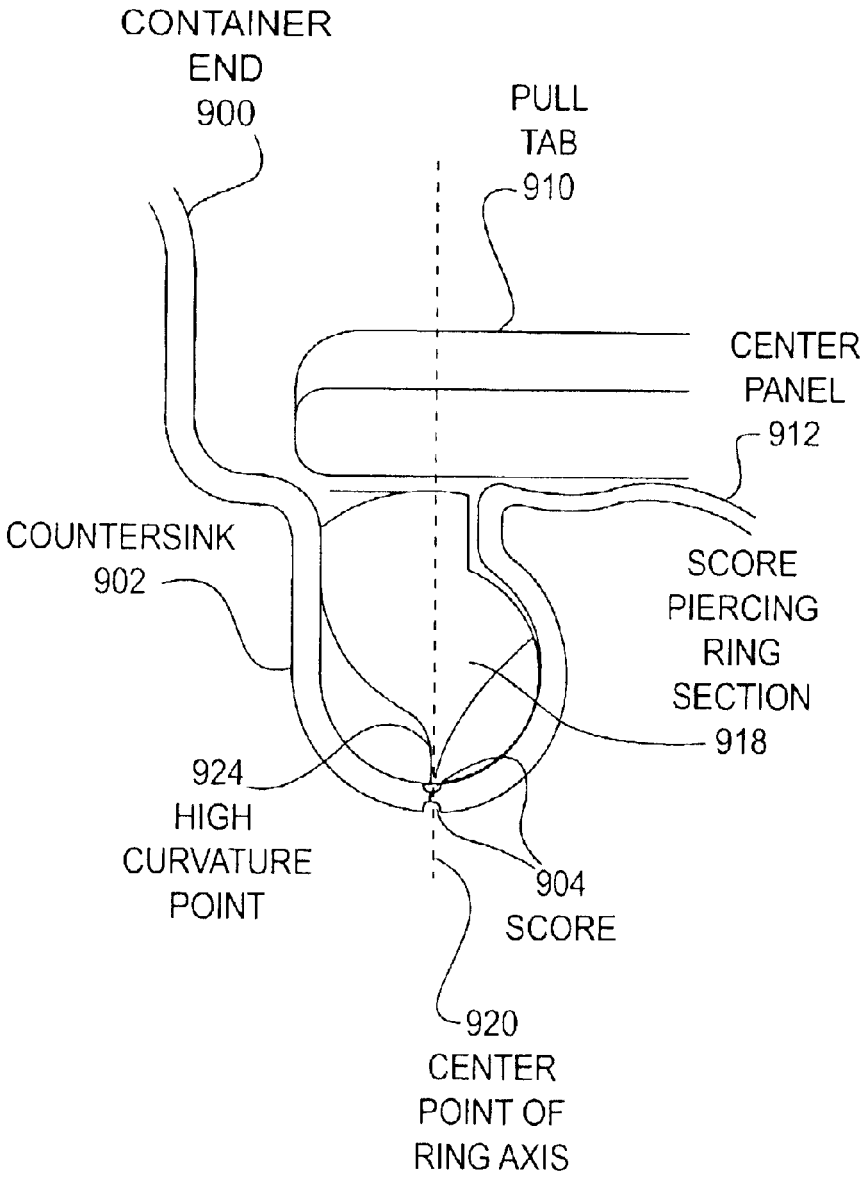
FIG. 9 is an axial cross sectional view of section 9—9 of FIG. 8 showing detail of the ring within the scored countersink.

FIG. 9 is an axial cross sectional view of section 9—9 of FIG. 8, showing detail of the score piercing ring section 918 of the one-piece pull tab 910 and ring 906 within the countersink 902 containing a score 904. As shown in FIG. 9, the axial cross-section of the score piercing ring section 918 is noncircular and contains a portion of high curvature 924 at a point opposite to the connection to the pull tab 910 and corresponding to a point nearest to the score 904 on the countersink 902. This point of high curvature 924 serves to maximize the sheer force distributed from the pull tab 910 to the score 904 and initiate a fracture site. As further shown in FIG. 9, the pull tab 910 attaches to the score piercing ring section 918 at a point slightly proximal to the distal end of the pull tab 910. This serves to create a lever action between the long and short end of the pull tab 910 with a point of connection between the ring and pull tab corresponding to the center point of the ring axis 920 thereby acting as a fulcrum. With the score piercing ring section 918 being held in a position as shown in FIG. 9 by the crimp 908 within the countersink 902, the upward force of pulling the pull tab 910 transmits an effective sheer force which is maximized by the point of high curvature 924 directly to the score 904 causing a discontinuity in the container end 900.

The center panel 912 of the container end 900 is then easily removed by propagating this fracture to the entire circumference. This is accomplished by an upward pulling motion with a finger inserted into the pull tab 910 and a corresponding downward pushing motion with the thumb near the midline of the center panel 912. After the center panel 912 of the container end 900 has been removed, the center panel 912 can now act as a recloseable cap for the container. The ring 906 is held in position by the inside portion of the countersink 902, and allows the ring 906 to function as an O-ring-like seal with the remaining outer portion of the countersink 902 of the container end 900.

Figure 10:
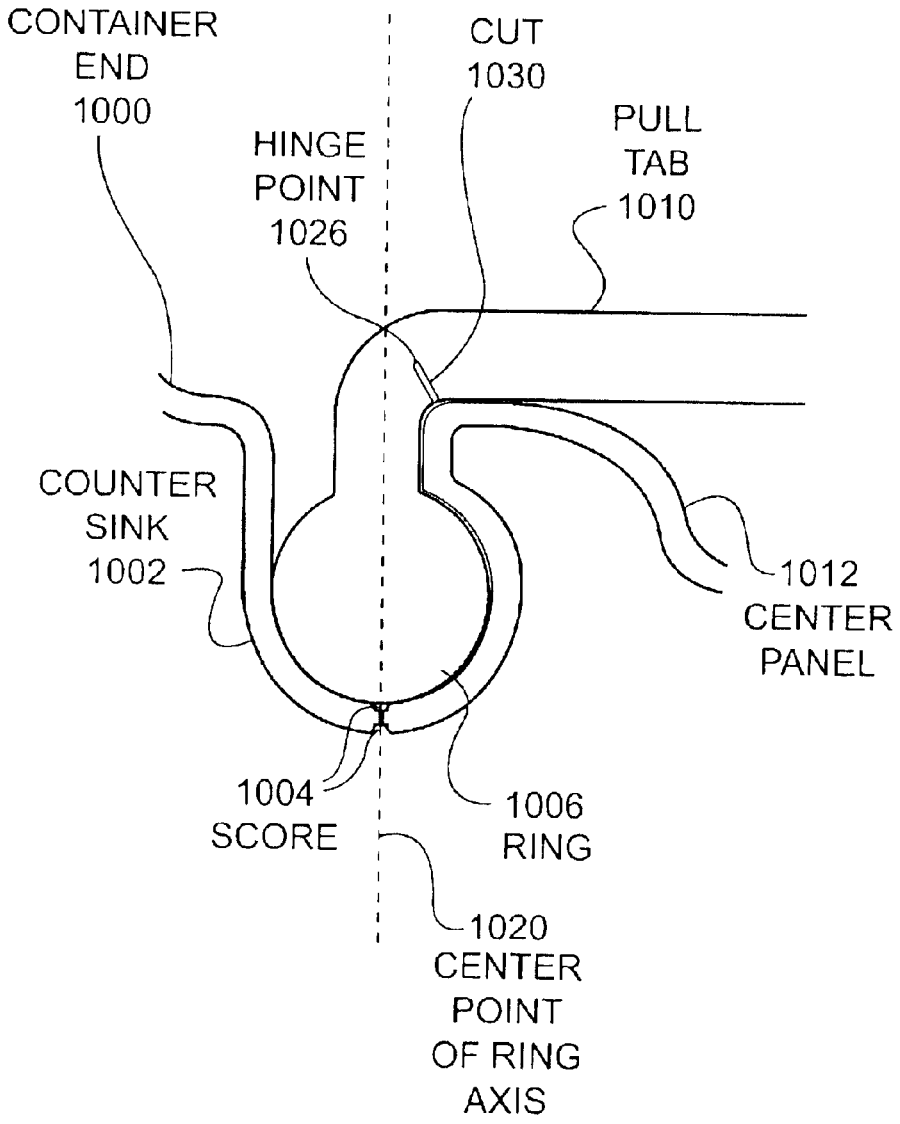
FIG. 10 is an axial cross sectional view of section 10—10 of FIG. 8 showing detail of the score piercing mechanism of the one-piece pull tab and ring within the scored countersink.

FIG. 10 is an axial cross sectional view of section 10—10 of FIG. 8 showing detail of the ring 1006 within the countersink 1002 containing a score 1004. As shown in FIG. 10, the axial cross section of the ring 1006 is semi-toroidal throughout most of its circumference with a marked change occurring only at the point directly under the connection to the pull tab 1010. Directly on either side of the score piercing section 918, (detailed in FIG. 9) the ring 1006 becomes more toroidal in shape throughout the rest of the circumference. In the area outlined in this axial cross sectional view, the pull tab 1010 is attached to the ring 1006 section in approximately a right angle to the center point of the ring axis 1020 and contains a partial cut 1030 in the material joining the pull tab 1010 member to the ring 1006 member. This partial cut allows the remaining material to act as a hinge point 1026 about which the arc of the pull tab 1010 is rotated. This hinge 1026 feature only exists on either side of the score piercing section 918 of the ring 1006 where the ring 1006 member attaches to the pull tab 1010 member.

Figure 11:
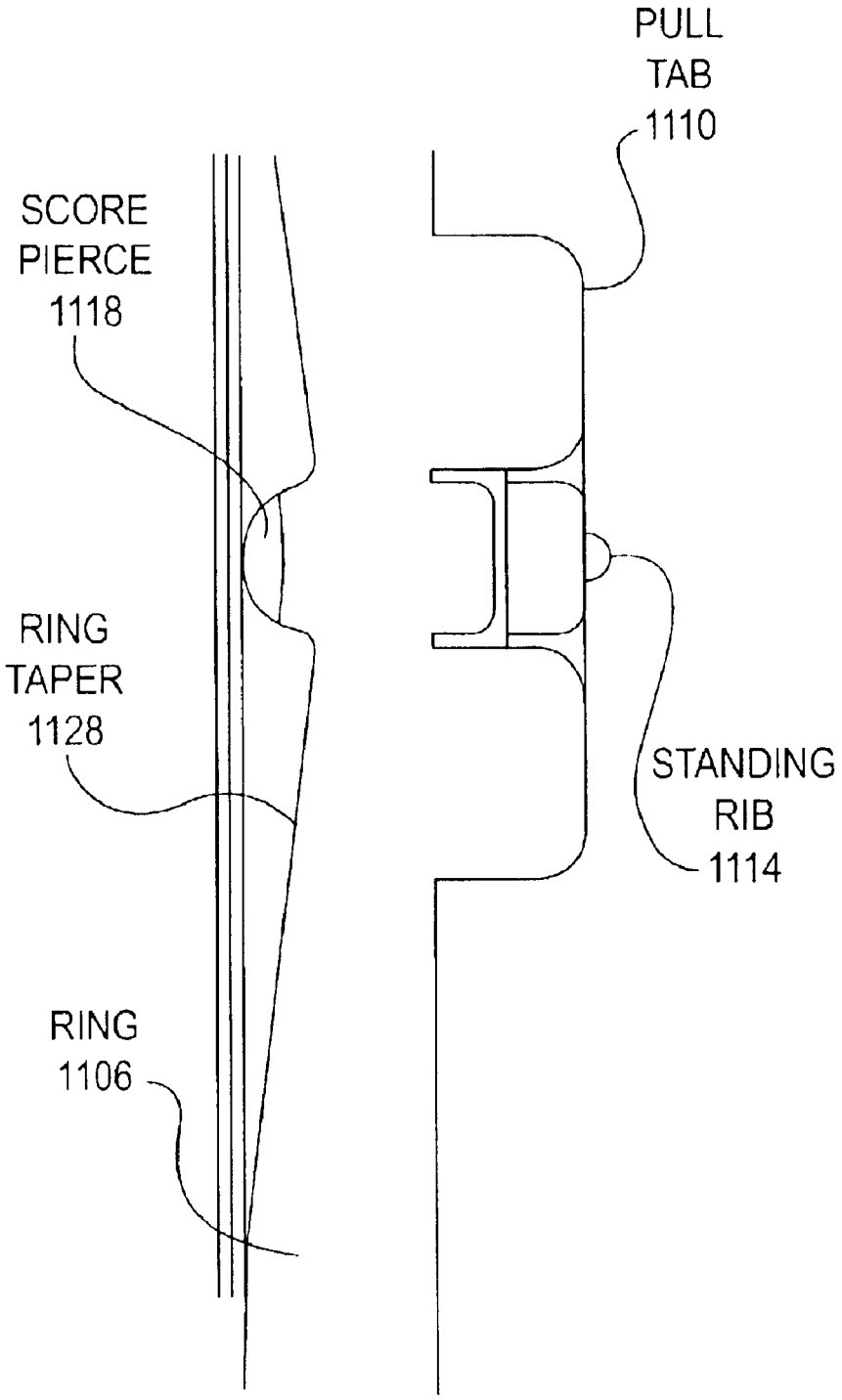
FIG. 11 is a radial cross sectional view of section 11—11 of FIG. 8 showing detail of the score piercing mechanism of the one-piece pull tab and ring.

FIG. 11 is a radial cross sectional view of section 11—11 of FIG. 8 showing detail of the score piercing mechanism 1118 of the one-piece pull tab 1110 and ring 1106. As shown in FIG. 11, the radial cross-section of the ring 1106 is tapered 1128 from the toroidal ring section (that exists everywhere but near the pull tab 1110 section of the ring 1106) to the score piercing feature 1118 (that is located directly under the midline of the pull tab 1110 and directly opposite the standing rib 1114). This tapering 1128 of the ring 1106 exposes the score piercing feature 1118 of the ring 1106 and allows for greater transmittal of force from the pull tab 1110 to the score piercing feature 1118.

The foregoing description of the invention has been presented for purposes of illustration and description. It is not intended to be exhaustive or to limit the invention to the precise form disclosed, and other modifications and variations may be possible in light of the above teachings. The embodiment was chosen and described in order to best explain the principles of the invention and its practical application to thereby enable others skilled in the art to best utilize the invention in various embodiments and various modifications as are suited to the particular use contemplated. It is intended that the appended claims be construed to include other alternative embodiments of the invention except insofar as limited by the prior art.

What is claimed is:

1. A method of creating an opening in a closed shell container comprising:

providing a segment of said closed shell container that is a single unitary structure and facilitates opening of said closed shell container;

creating a countersink in said segment that protrudes inwardly from the outer surface of said container shell;

creating an area of weakness in a portion of said countersink to facilitate preferential separation along said area of weakness;

placing a semi-toroidal shaped ring within said countersink, said countersink having a depth greater than the radius of said ring;

crimping said countersink on at least one lateral surface to a dimension less than the diameter of said ring, between the portion of said countersink that retains said ring and said outer surface of the container shell, to retain said ring within said countersink and force said countersink open when said ring is pulled out of said countersink which propagates a discontinuity in the container material in said area of weakness so as to create said opening in said closed shell container.

2. A method of claim 1 wherein said closed shell container is metallic.

3. A method of claim 1 wherein said area of weakness on a portion of said countersink is an area of lesser material thickness than the rest of said countersink.

4. A method of claim 1 wherein said ring is a continuous closed loop of rigid material that forces said countersink open in a bi-directional manner to create said opening, and said ring remains as said continuous closed loop upon said creation of said opening.

5. A method of claim 1 wherein said ring is a continuous strand of rigid material that forces said countersink open in a uni-directional manner to create said opening, and said ring remains as said continuous strand upon said creation of said opening.

6. A method of claim 1 wherein said ring is a continuous loop of rigid material that forces said countersink open in a bi-directional manner to create said opening, and said ring remains as said continuous loop confined within the remnant of said countersink of the removed portion of said container shell upon said creation of said opening.

7. A method of claim 1 wherein said ring is connected to a rivetless actuator to facilitate said removal from said countersink.

8. A method of claim 1 wherein said discontinuity is propagated as a result of material fatigue at said area of weakness on said countersink.

9. A method of claim 8 wherein said initial separation of material is propagated by the force transmitted to said area of weakness on said countersink by removing said ring.

10. A method of claim 1 wherein said ring is connected to a rivetless actuator which when actuated facilitates an initial separation of material in said area of weakness on said countersink.

11. A method of creating an opening in a closed shell metal container comprising:

providing an end segment of said closed shell container that is a single unitary structure and facilitates opening of said closed shell container;

creating a countersink in said end segment comprising a groove that protrudes inward from an outer surface of said container shell;

scoring at least one surface in said closed loop on a portion of said countersink to facilitate preferential separation along said score;

placing a semi-toroidal shaped ring comprising a continuous closed loop of rigid material connected to a rivetless actuator, within said countersink, said countersink having a depth greater than the radius of said ring;

retaining said ring within said countersink by crimping said countersink on at least one lateral surface to a dimension less than the diameter of said ring;

initiating a separation in said score on said material within said countersink by transferring a force from said rivetless actuator through said ring to said score, that forces said countersink open when said ring is pulled out of said countersink which propagates a discontinuity in the container material along said score so as to create said opening in said closed shell container.

12. A method of claim 11 wherein said crimping is located between a portion of said countersink that retains said ring, and said outer surface of the container shell.

13. A device for creating an opening in a closed shell container comprising:

a segment that is a single unitary structure that forms a portion of said closed shell container and facilitates opening of said closed shell container;

a closed loop countersink in said segment that protrudes inwardly from an outer surface of said container shell;

an area of weakness in said closed loop on a portion of said countersink that facilitates a preferential separation along said area of weakness;

a semi-toroidal shaped ring placed within said countersink, said countersink having a depth greater than the radius of said ring;

a crimp to retain said ring within said countersink on at least one lateral surface of said countersink to a dimension less than the diameter of said ring, said crimp located between the portion of said countersink that retains said ring, and said outer surface of the container shell;

a rivetless actuator connected to said ring so that when said rivetless actuator is pulled, said ring is removed from said countersink forcing said countersink open which propagates a discontinuity in said area of weakness an opening in said container shell.

14. A device of claim 13 wherein said closed shell container is metallic.

15. A device of claim 13 wherein said area of weakness on a portion of said countersink is an area of lesser material thickness than the rest of said countersink.

16. A device of claim 13 wherein said ring is a continuous closed loop of rigid material that forces said countersink open in a bi-directional manner to create said opening, and said ring remains as said continuous closed loop upon said creation of said opening.

17. A device of claim 13 wherein said ring is a continuous strand of rigid material that forces said countersink open in a uni-directional manner to create said opening, and said ring remains as said continuous strand upon said creation of said opening.

18. A device of claim 13 wherein said ring is a continuous closed loop of rigid material that forces said countersink open in a bi-directional manner to create said opening, and said ring remains as said continuous closed loop confined within the remnant of said countersink of the removed portion of said container shell upon said creation of said opening.

19. A device of claim 13 wherein said rivetless actuator is a pull tab.

20. A device of claim 13 wherein said discontinuity is propagated as a result of material fatigue at said area of weakness on said countersink.

21. A device of claim 13 wherein the action of said rivetless actuator facilitates an initial separation of material in said area of weakness on said countersink.

22. A device of claim 21 wherein said initial separation of material is propagated throughout said area of weakness, thereby creating an opening in said container shell by the force transmitted to said countersink by removing said ring.

23. A device for creating an opening in a closed shell metal container comprising:

an end segment that is a single unitary structure that forms a portion of said closed shell container and facilitates opening of said closed shell container;

a countersink comprising a groove that protrudes inward from said end segment of said closed shell metal container;

a score on at least one surface of said countersink to facilitate preferential separation along said score;

a semi-toroidal shaped ring comprising a continuous closed loop of rigid material connected to a pull tab, within said countersink, said countersink having a depth greater than the radius of said ring;

said ring retained within said countersink by crimping said countersink on at least one lateral surface to a dimension less than the diameter of said ring;

a rivetless actuator that is connected to said ring and initiates a separation in said container shell along said score by transferring a force from said actuator through said ring to said score when said rivetless actuator is pulled;

said ring propagating said separation along said score by transmitting the force of removing said ring from said container shell to said score, thereby creating said opening in said closed shell metal container.

24. A device of claim 23 wherein said crimping is located between a portion of said countersink that retains said ring, and said outer surface of the container shell.

25. A device for creating an opening in a closed shell metal container comprising:

a countersink means for providing a groove that protrudes inward from an outer surface of the container shell around the periphery of an end of said container;

a scoring means for providing a preferential separation location within said countersink a ring means connected to a pull tab for disposal in said countersink;

a crimping means for retaining said ring in said countersink and creating an interference on at least one lateral surface of said countersink;

a rivetless actuating means connected to said ring means for transferring a force from said rivetless actuator through said ring to said score, and force said countersink open when said ring is pulled out of said countersink which propagates a discontinuity in the container material along said score so as to create said opening in said closed shell container.

26. A method of creating an opening in an end cap of a closed shell container comprising:

providing said end cap that is a single unitary structure that forms a portion of said closed shell container;

creating a countersink in said end cap that protrudes inwardly from the outer surface of said container shell;

creating an area of weakness in a portion of said countersink to facilitate preferential separation along said area of weakness;

placing a semi-toroidal shaped ring within said countersink, said countersink having a depth greater than the radius of said ring;

crimping said countersink on at least one lateral surface to a dimension less than the diameter of said ring, between the portion of said countersink that retains said ring and said outer surface of the container shell, to retain said ring within said countersink and force said countersink open when said ring is pulled out of said countersink which propagates a discontinuity in the container material in said area of weakness so as to create said opening in said closed shell container.

27. A method of claim 26 wherein said closed shell container is metallic.

28. A method of claim 26 wherein said area of weakness on a portion of said countersink is an area of lesser material thickness than the rest of said countersink.

29. A method of claim 26 wherein said ring is a continuous closed loop of rigid material that forces said countersink open in a bi-directional manner to create said opening, and said ring remains as said continuous closed loop upon said creation of said opening.

30. A method of claim 26 wherein said ring is a continuous strand of rigid material that forces said countersink open in a uni-directional manner to create said opening, and said ring remains as said continuous strand upon said creation of said opening.

31. A method of claim 26 wherein said ring is a continuous loop of rigid material that forces said countersink open in a bi-directional manner to create said opening, and said ring remains as said continuous loop confined within the remnant of said countersink of the removed portion of said container shell upon said creation of said opening.

32. A method of claim 26 wherein said ring is connected to a rivetless actuator to facilitate said removal from said countersink.

33. A method of claim 26 wherein said discontinuity is propagated as a result of material fatigue at said area of weakness on said countersink.

34. A method of claim 26 wherein said ring is connected to a rivetless actuator which when actuated facilitates an initial separation of material in said area of weakness on said countersink.

35. A method of creating an opening in a closed shell metal container comprising:

providing an end segment of said closed shell container that is a single unitary structure that seals said closed shell container and facilitates opening of said closed shell container;

creating a countersink in said end segment comprising a groove that protrudes inwardly from an outer surface of said container shell;

scoring at least one surface in said closed loop on a portion of said countersink to facilitate preferential separation along said score;

placing a semi-toroidal shaped ring comprising a continuous closed loop of rigid material connected to a rivetless actuator, within said countersink, on said outer surface of said sealed closed shell container, structured such that said ring does not act as a seal of said closed shell container, said countersink having a depth greater than the radius of said ring;

retaining said ring within said countersink by crimping said countersink on at least one lateral surface to a dimension less than the diameter of said ring;

initiating a separation in said score on said material within said countersink by transferring a force from said rivetless actuator through said ring to said score, that forces said countersink open when said ring is pulled out of said countersink which propagates a discontinuity in the container material along said score so as to create said opening in said closed shell container.

36. A device for creating an opening in a closed shell metal container comprising:

an end segment that is a single unitary structure that forms a portion of and seals said closed shell container and facilitates opening of said closed shell container;

a countersink comprising a groove that protrudes inwardly from said end segment of said closed shell metal container;

a score on at least one surface of said countersink to facilitate preferential separation along said score;

a semi-toroidal shaped ring comprising a continuous closed loop of rigid material connected to a pull tab, said ring disposed within said countersink, on said outer surface of said sealed closed shell container, such that said ring does not act as a seal of said closed shell container;

said ring retained within said countersink by crimping said countersink on at least one lateral surface to a dimension less than the size of the axial cross-section of said ring so that the ring is retained within the countersink;

an actuator that is connected to said ring that transfers a force from said actuator through said ring to said score when said rivetless actuator is pulled to cause said countersink to open and propagate a discontinuity along said score to produce an opening in said closed shell metal container.

* * * * *